US011795599B2

(12) United States Patent
Anburaj et al.

(10) Patent No.: US 11,795,599 B2
(45) Date of Patent: Oct. 24, 2023

(54) WASHER APPLIANCE WITH REMOVABLE AGITATOR POST HAVING RELEASABLE BALL MECHANISM

(71) Applicant: Haier US Appliance Solutions, Inc., Wilmington, DE (US)

(72) Inventors: Ravikumar Anburaj, Tenkasi (IN); Sankar Selvaraj, Puducherry (IN); V V Subrahmanyeswara Rao Kasa, West Godavari (IN); Sirish Yerramalli, Hyderabad (IN); Tarun Guniganti, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 102 days.

(21) Appl. No.: 17/351,344

(22) Filed: Jun. 18, 2021

(65) Prior Publication Data

US 2022/0403579 A1 Dec. 22, 2022

(51) Int. Cl.
*D06F 37/24* (2006.01)
*D06F 37/12* (2006.01)

(52) U.S. Cl.
CPC ..... *D06F 37/24* (2013.01); *D06F 37/12* (2013.01)

(58) Field of Classification Search
CPC ..... D06F 37/24; D06F 37/12
See application file for complete search history.

(56) References Cited

U.S. PATENT DOCUMENTS

| | | | | |
|---|---|---|---|---|
| 2,851,200 | A | 9/1958 | De Foa | |
| 7,814,612 | B2 | 10/2010 | Bobrosky | |
| 7,967,170 | B2 | 6/2011 | Goff | |
| 8,601,643 | B2 | 12/2013 | Eriksson | |
| 9,615,708 | B2 | 4/2017 | Kowalski | |
| 10,226,157 | B2 | 3/2019 | D'Amico | |
| 10,787,761 | B2 | 9/2020 | Czarnecki | |
| 2019/0101234 | A1* | 4/2019 | Quang | F16L 37/086 |
| 2020/0399811 | A1* | 12/2020 | Czarnecki | D06F 31/00 |
| 2022/0298705 | A1* | 9/2022 | Ford | D06F 13/04 |

FOREIGN PATENT DOCUMENTS

| | | | |
|---|---|---|---|
| BR | MU9002286 | U2 | 3/2013 |
| CN | 211284936 | U | 8/2020 |
| GB | 2413942 | A | 11/2005 |
| JP | 2018521707 | A | 8/2018 |
| WO | WO2016123345 | A1 | 8/2016 |

* cited by examiner

*Primary Examiner* — Joseph L. Perrin
(74) *Attorney, Agent, or Firm* — Dority & Manning, P.A.

(57) ABSTRACT

A washer appliance with removable agitator post including a shaft positioned within the agitator post. A plunger may be attached to the shaft near the bottom end of the agitator post and is movable between an up position and a down position along the vertical axis. A plurality of bearings may be positioned between the plunger and the agitator post and configured for selective contact with the receptacle by movement through the openings at the bottom end of the agitator post so as to secure the agitator post in the receptacle when the plunger is in the up position and release the agitator post from the receptacle when the plunger is in the down position.

18 Claims, 12 Drawing Sheets

WASHER APPLIANCE WITH REMOVABLE AGITATOR POST HAVING RELEASABLE BALL MECHANISM

FIELD OF THE INVENTION

The subject matter of the present disclosure relates generally to a washer appliance having a removable agitator post.

BACKGROUND OF THE INVENTION

Washing appliances (also referred to as "washing machines") typically include a drum or basket for receipt of articles to be washed. Top-load or vertical axis washing machines rotate the drum about the vertical axis at various points during the cleaning cycle. Various components provide for adding fluid into the drum and for imparting motion to the fluid and articles being washed in order to clean the articles.

Conventionally, the washing appliance may include a knob or other switch by which the user selects the level of fluid in the vertical axis washing machine based on e.g., the load size of articles being washed. The user visually determines the desired fluid level based on the anticipated load size. Many washing appliance users are also accustomed to seeing a conventional agitator in the form of a post extending up from the bottom of the wash basket and configured to impart motion to the fluid and articles during the cleaning cycles. Users may associate factors such as fluid level and movement of the agitator as directly related to the effective cleaning of the articles and may believe that increased fluids levels and agitator action are advantageous.

Certain articles may require more wash space within the wash drum. For example, large garments, pillows, comforters and the like may require more volume for washing than typical articles of clothing. Sufficient space is required in order for the washing appliance to be able to impart motion to the articles and wash fluid as part of the cleaning process. Conventional agitator designs having a post that extends into the wash basket necessarily consume at least part of this space. In addition, in such designs the agitator is typically not designed for removal by the user of the appliance.

Improvements in technology and increasing water conservation requirements have resulted in washing appliances that can use less water during the cleaning cycle and may use features other than the conventional post-type agitator for imparting the desired movement of the articles within the wash basket or wash drum. For example, rotatable impellers have been developed that can impart the desired movement while consuming less volume inside the wash drum than the conventional agitator. Some washing appliances utilizing such designs may also be able to use less water during the cleaning cycle as well.

However, user perception of washing machine features that provide for the best cleaning experience may contradict the actual impact of such features. As previously mentioned, consumers familiar with a conventional post-type agitator extending vertically from the bottom of the wash drum may be reluctant to purchase or use a vertical-axis washing appliance lacking such feature. Yet, depending on the particular design employed, an impeller located at the bottom of the wash drum may have more impact in creating the desired agitation and cleaning of articles than the conventional agitator—including under conditions of less water usage.

And for larger loads or loads with larger articles, the space consumed by the conventional post-type agitator is needed for the articles.

Accordingly, a washing appliance with a removable agitator would be useful. More particularly, a washing appliance that allows the user to readily install or remove an agitator while still providing for effective cleaning of articles would be beneficial. Such as washing appliance that can allow of the installation or removal without requiring special tools would be particularly beneficial.

BRIEF DESCRIPTION OF THE INVENTION

Additional aspects and advantages of the invention will be set forth in part in the following description, or may be apparent from the description, or may be learned through practice of the invention.

In one exemplary embodiment, the present invention provides a washing appliance including a cabinet and a wash tub positioned in the cabinet and defining a wash chamber. A wash drum is rotatably mounted within the wash chamber and is configured for receiving articles for washing. An impeller is positioned in the wash drum. The impeller is rotational about a vertical axis and is configured for imparting motion to the articles during washing. The impeller can support a receptacle. An agitator post may be configured for removable positioning in the receptacle of the impeller, the agitator post having a top end and a bottom end, the agitator defining a plurality of openings positioned about the bottom end. A shaft may be positioned within the agitator post and extend between the top end and the bottom end of the agitator post. A plunger can be attached to the shaft near the bottom end of the agitator post, the plunger movable between an up position and a down position along the vertical axis. A plurality of bearings may be positioned between the plunger and the agitator post and configured for selective contact with the receptacle by movement through the openings at the bottom end of the agitator post so as to secure the agitator post in the receptacle when the plunger is in the up position and release the agitator post from the receptacle when the plunger is in the down position.

In another exemplary embodiment, the present invention provides a washing appliance with a wash drum rotatably mounted within a wash chamber and configured for receiving articles for washing. An impeller is positioned in the wash drum. The impeller is rotational about a vertical axis and configured for imparting motion to the articles during washing. A receptacle can be supported by the impeller. An agitator post may be removably positioned in the receptacle, the agitator post and having a top end and a bottom end, the agitator post defining a plurality of openings at the bottom end, the openings oriented and tapered along a radial direction. A shaft may extend within the agitator post, the shaft movable up and down along a direction parallel to the vertical axis. A plunger can be connected with the shaft and positioned proximate to the bottom end of the agitator post, the plunger configured for movement by the shaft between an up position and a down position, the plunger defining a plurality of sockets spaced apart along a circumferential direction. A plurality of bearings may be confined between the plunger and the agitator post, each bearing movable between one of the sockets and one of the openings of the agitator post when the plunger is in the down position, each bearing forced into one of the openings in locking contact with the receptacle when the plunger is in the up position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of the same or similar reference numbers in the figures denotes same or similar features unless the context indicates otherwise.

DETAILED DESCRIPTION OF THE INVENTION

Figure 1:
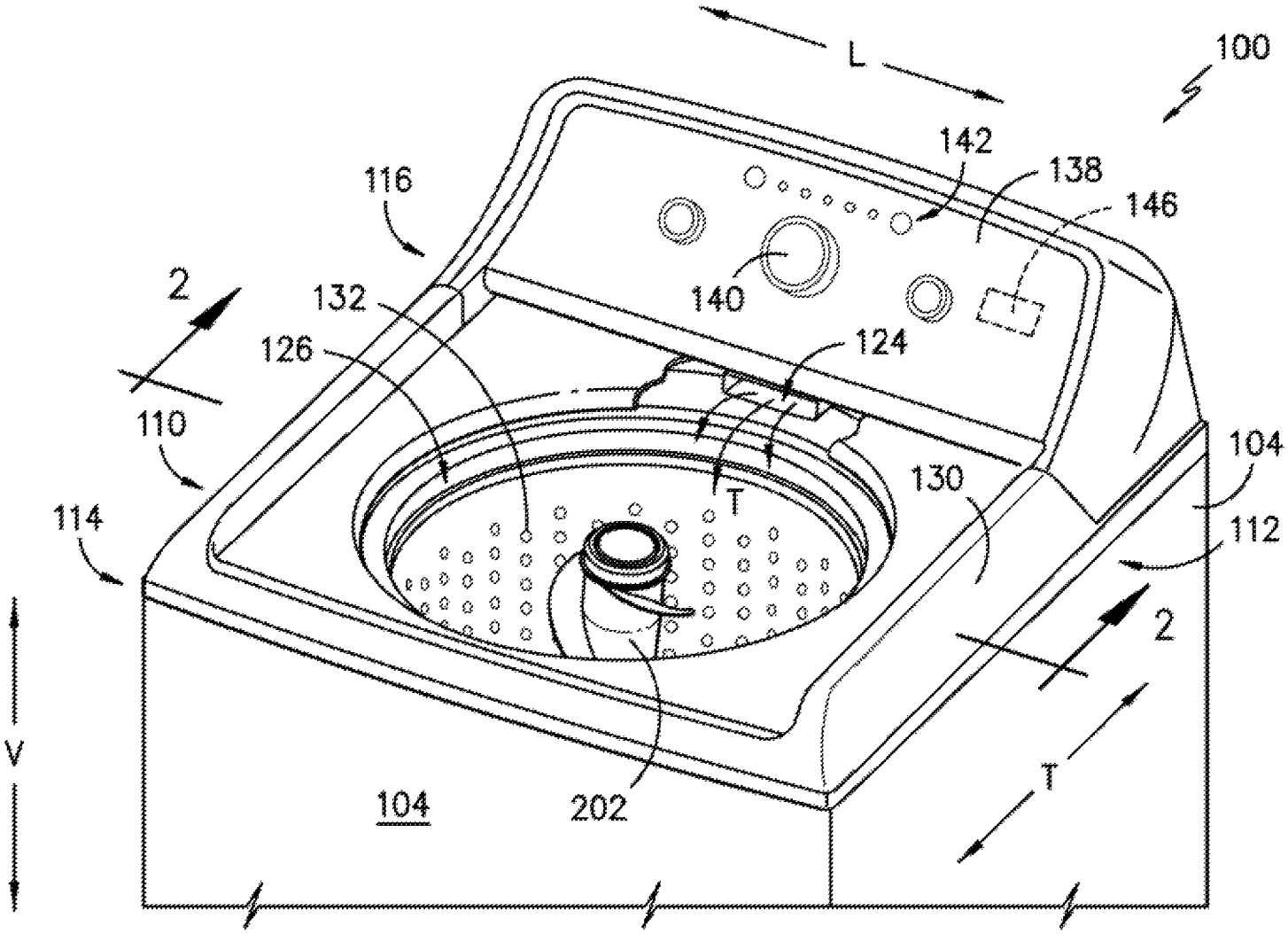
FIG. 1 provides a partial perspective view of an exemplary embodiment of a washing machine of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
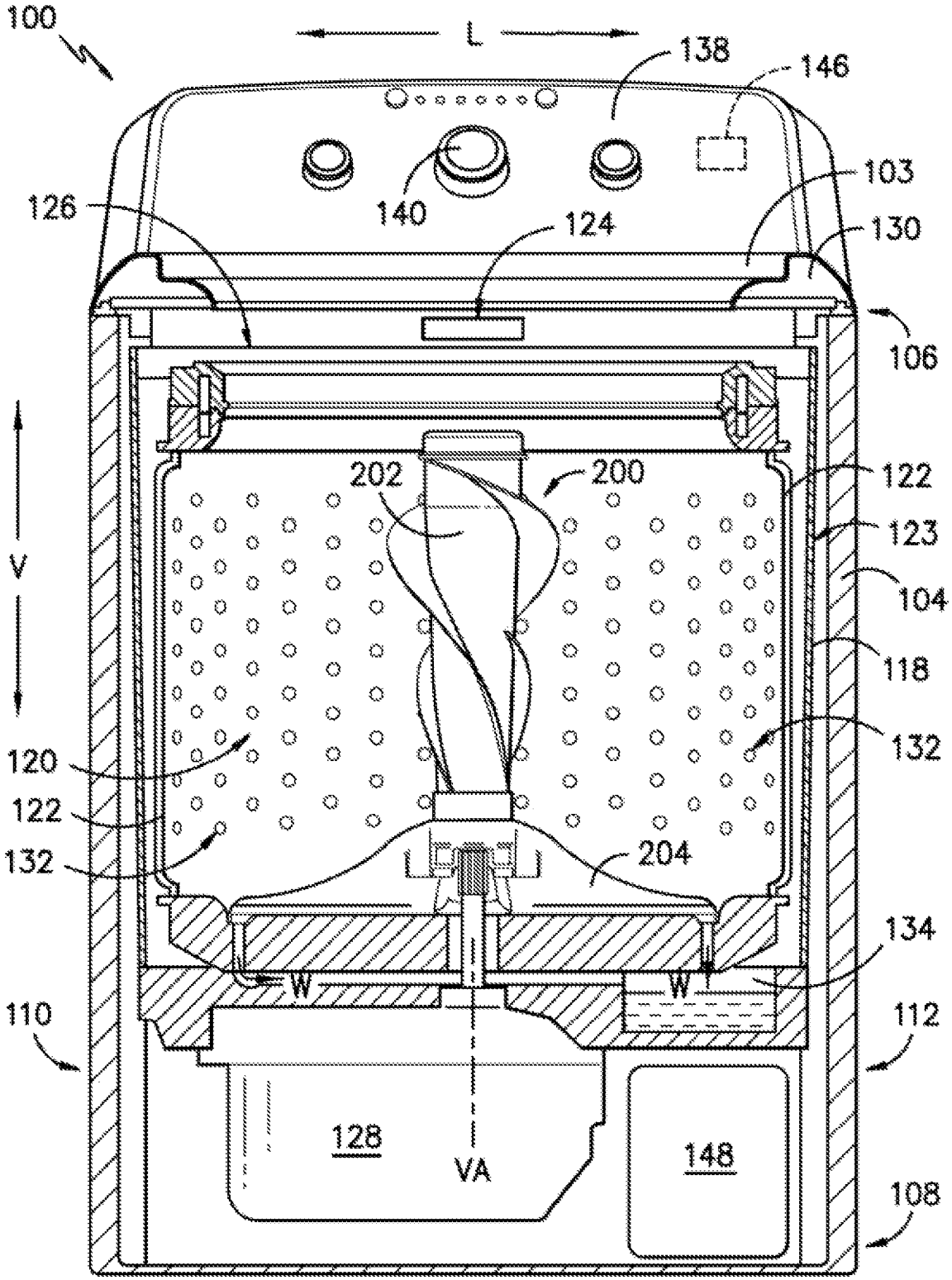
FIG. 2 provides a front cross-sectional view of the exemplary washing machine of FIG. 1.

FIGS. 1 and 2 illustrate an exemplary embodiment of a vertical axis washing appliance 100 of the present invention, which is also sometimes referred to as a top loading or vertical axis washing machine. In FIG. 1, a door 103 (shown in FIG. 2) has been removed for purposes of illustrating other features of the invention. Washing machine appliance 100 has a cabinet 104 that extends between a top portion 106 and a bottom portion 108 along the vertical direction V, between a first side (left) 110 and a second side (right) 112 along the lateral direction L, and between a front 114 and a rear 116 along the transverse direction T. The present invention is not limited to the particular vertical axis washing appliance 100 shown in the figures. Using the teachings disclosed herein, one or skill in the art will understand the other embodiments of a washing machine are also in the scope of the present invention.

As best shown in FIG. 2, a wash tub 118 is positioned within cabinet 102, defines a wash chamber 120, and is generally configured for retaining wash fluids during an operating cycle. A wash drum 122 is rotatably mounted within wash chamber 120 of wash tub 118. Washing machine appliance 100 further includes a dispenser 124 for dispensing wash fluid into wash tub 118. In addition, appliance 100 may include one or more additional dispensers for directing fluid into wash tub 118 and each dispenser may be separately controlled by one or more valves controlling flow to each dispenser independently of the others. The term "wash fluid" refers to a liquid used for washing and/or rinsing articles during an operating cycle and may include any combination of water, detergent, fabric softener, bleach, and other wash additives or treatments. As used herein, the term "cleaning cycle" includes a wash cycle, rinse cycle, spin cycle, or combinations thereof.

Wash drum 122 and cabinet 104 generally define an opening 126 (accessible through door 103) for receipt of articles for washing. Wash drum 122 rotates about a vertical axis of rotation VA (FIGS. 2 and 3) powered by motor assembly 128. According to the illustrated embodiment, the axis of rotation VA is substantially parallel to the vertical direction V. As used herein, terms of approximation, such as "approximately," "substantially," or "about," refer to being within a ten percent margin of error.

As illustrated, cabinet 104 of washing machine appliance 100 has a top panel 130. Top panel 130 defines an opening (FIG. 1) that coincides with opening 126 of wash tub 118 to permit a user access to wash drum 122. Door 103 is rotatably mounted to top panel 130 to permit selective access to opening 126. In particular, door 103 selectively rotates between a closed position and an open position. In the closed position, door 103 inhibits access to wash drum 122. Conversely, in the open position, a user can access wash drum 122. Although door 103 is illustrated as mounted to top panel 130, door 103 may alternatively be mounted to cabinet 104 or any other suitable support.

As best shown in FIG. 2, wash drum 122 further defines a plurality of perforations 132 to facilitate fluid communication between an interior of wash drum 122 and wash tub 118. In this regard, wash drum 122 is spaced apart from wash tub 118 to define a space for wash fluid to escape wash chamber 120. During a spin cycle, wash fluid within articles being washed (e.g., clothing) and within wash chamber 120 is urged through perforations 132 wherein it may collect in a sump 134 defined by wash tub 118. Washing machine appliance 100 further includes a pump assembly 148 (FIG. 2) that is located beneath wash tub 118 and wash drum 122 for gravity assisted flow when draining wash tub 118.

An exemplary article movement mechanism 200, including impeller 204 (FIGS. 2 and 3) and agitator post 202, is rotatably mounted within wash drum 122 to impart motion to articles and liquid in wash drum 122. More specifically, impeller 204 and agitator post 202 extend into wash drum 122 and assist agitation of articles disposed within wash drum 122 (as will be later described) during operation of washing appliance 100, e.g., to facilitate improved cleaning. For this exemplary embodiment, agitator post 202 includes a helical vane 210 extending from the outer surface 212 of agitator post 202 between bottom end 216 and top end 214 thereof. Helical vane 210 may be configured to assist the agitation of articles or support the overall desired motion thereof during a cleaning cycle. As will be understood by one of skill in the art using teachings disclosed herein, helical vane 210 may have different shapes, thickness, and other features from what is depicted in the figures and may actually include multiples sets of overlapping or non-overlapping vanes.

In different embodiments, impeller 204 and agitator post 202 may rotate separately or together. Such rotations include a single action element (i.e., oscillatory only), a double action element (oscillatory movement at one end, single direction rotation at the other end) or a triple action element (oscillatory movement plus single direction rotation at one end, single direction rotation at the other end). Impeller 204, agitator post 202, and wash drum 122 are oriented to rotate about a vertical axis of rotation VA (which is substantially parallel to vertical direction V). For example, impeller 204 and/or agitator post 202 may rotate back and forth in alternate directions about vertical axis VA during a cleaning cycle. Additional description of the actions of impeller 204 and agitator post 202 are set forth below.

As stated, washing machine appliance 100 includes a motor assembly 128 in mechanical communication with wash drum 122 to selectively rotate wash drum 122 (e.g., during a wash cycle or a rinse cycle of washing machine appliance 100). In addition, motor assembly 128 may also be in mechanical communication with impeller 204 and agitator post 202. For this embodiment, impeller 204 is secured to a shaft 248 from motor assembly 128 by a fastener 246. In this manner, motor assembly 128 may be configured for selectively and independently rotating or oscillating wash drum 122, impeller 204, and/or agitator post 202 during various operating cycles of washing machine appliance 100.

Figure 3:
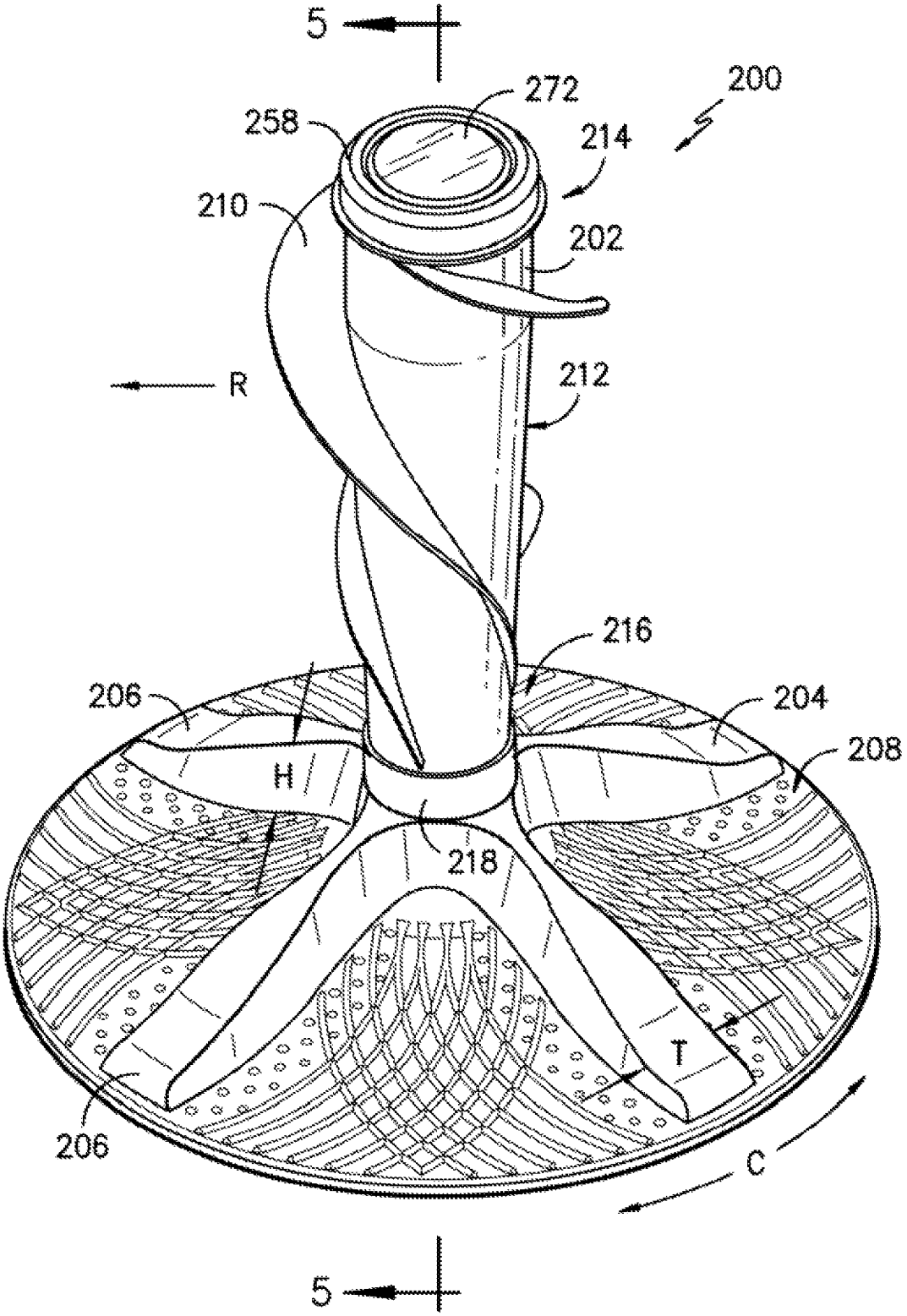
FIG. 3 provides a perspective view of an exemplary embodiment of an article movement mechanism of the present invention in which an exemplary agitator post is included.

Referring still to FIGS. 1 through 3, a control panel 138 with at least one input selector 140 (FIGS. 1 and 2) extends from top panel 130. Control panel 138 and input selector 140 collectively form a user interface input for operator selection of machine cycles and features of washing appliance 100. A display 142 of control panel 138 indicates selected features, operation mode, a countdown timer, and/or other items of interest to appliance users regarding operation.

Operation of washing machine appliance 100 is controlled by at least one controller or processing device 146 that is operatively coupled to control panel 138 for user manipulation to select washing machine cycles and features. In response to user manipulation of control panel 138, controller 146 operates the various components of washing machine appliance 100 to execute selected machine cycles and features. According to an exemplary embodiment, controller 146 may include a memory and microprocessor, such as a general or special purpose microprocessor operable to execute programming instructions or micro-control code associated with methods described herein. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 138 and other components of washing machine appliance 100 may be in communication with controller 146 via one or more signal lines or shared communication busses.

During operation of washing machine appliance 100, laundry items are loaded into wash drum 122 through opening 126, and washing operation is initiated through operator manipulation of input selector 140. Water, detergent and/or other fluid additives can be added to wash tub 118 and wash drum 122 through dispenser 124 and/or other dispensers as well. Controller 146 can operate one or more valves of washing appliance 100 to provide for filling wash tub 118 and wash drum 122 to the appropriate level for the amount of articles being washed and/or rinsed. By way of example for a wash mode, once wash drum 122 is properly filled with fluid, the contents of wash drum 122 can be agitated (e.g., with article movement mechanism 200 as discussed previously) for washing of laundry items in wash drum 122. The specific operation of wash appliance 100 by controller 146 will depend on various inputs including the cycle and other settings that may be selected by the user, the amount of article placed in wash chamber 120, and other variables as will be understood by one of skill in the art using the teachings disclosed herein.

By way of continuing example, after wash tub 118 is filled and the agitation phase of the wash cycle is completed, wash tub 118 and drum 122 can be drained, e.g., by drain pump assembly 148. Laundry articles can then be rinsed by again adding fluid to wash drum 122 and tub 118 again depending on the specifics of the cleaning cycle selected by a user. The impeller 204 and/or agitator post 202 may also provide agitation within wash drum 122. One or more spin cycles may also be used as part of the cleaning process. In particular, a spin cycle may be applied after the wash cycle and/or after the rinse cycle in order to wring wash fluid from the articles being washed. During a spin cycle, wash drum 122 is rotated at relatively high speeds to help wring fluid from the laundry articles through perforations 132. After articles disposed in wash drum 122 are cleaned and/or washed, the user can remove the articles from wash drum 122, e.g., by reaching into wash drum 122 through opening 126.

As will now be further described, the exemplary article movement mechanism 200 allows desired movements to be imparted to articles in wash drum 122 during a cleaning cycle. These movements, which can include combinations of movement along vertical direction V and radial direction R, assist in cleaning articles while in the wash fluid. One exemplary pattern of movement will now be described. Using the teachings disclosed herein, one of skill in the art will understand that other patterns or paths of fluid and/or article movement in drum 122 may be used as well in other embodiments of the invention.

For example, after articles to be cleaned and fluid are loaded into cylindrical wash drum 122, rotations of impeller 204 may impart an inverse toroidal motion to articles in wash drum 122 during a cleaning cycle. In such motion, articles may move vertically upward from impeller 204 along agitator post 202 and then radially outward (the radial direction is indicated by arrow R in FIG. 3, which is a direction perpendicular to vertical axis VA) at the top of an article load towards the cylindrical portion 123 of wash drum 122.

The articles then move vertically downward towards impeller 204 and radially inward along the bottom of an article load towards agitator post 202 where the cycle repeats under the influence of components such as impeller 204. Accordingly, during a cleaning cycle, this inverse toroidal motion results generally in a turnover of articles in wash drum 122. As used herein, "inverse toroidal motion" or "inverse toroidal movement" does not refer to the specific movement necessarily of any individual article but to the overall movement of articles in wash drum 122 instead. A variety of factors create the inverse toroidal motion the occurs in wash drum 122 including, for example, the relative amounts of fluid and articles present in drum 122, the shape of wash drum 122, the configuration and movements of agitator post 202, the configuration and movements of impeller 204, and other factors as well.

With reference to FIG. 3, for this exemplary embodiment of mechanism 200, impeller 204 includes a plurality of radial lobes 206 spaced apart along circumferential direction C. Each lobe 206 has thickness T as measured along the circumferential direction C that varies moving along radial direction R. For the exemplary embodiment shown, thickness T narrows and then widens moving along radial direction R and away from agitator post 202. Each lobe 206 also has a height H above impeller base 208 along axial direction A that also varies along radial direction R. For the exemplary embodiment shown, height H gradually decreases moving along radial direction R and away from agitator post 202. Impeller 204 as depicted in FIGS. 2 and 3 is provided by way of example only. Other shapes and configurations may be used as well.

As noted, the configuration of impeller 204 assists in creating the desired movement of fluid and/or articles within wash drum 122. Article movement mechanism 200 also includes an agitator post 202 which may assist in providing or supporting the desired movement. In addition, using features as will also be described, agitator post 202 can be readily installed or removed by a user of appliance 100 without the use of special tools. Removal of agitator post 202 allows more volume within wash drum 122 for the receipt of articles and/or fluid. At the same time, agitator post 202 can be readily installed as may be needed for a particular movement of articles in drum 122 or as may be based on e.g., user preference. An exemplary embodiment of agitator post 202 is set forth in the figures and will now be further described.

Referring to FIGS. 3 through 15, for this exemplary embodiment, agitator post 202 is removably positioned in a receptacle 218 supported by impeller 204. Receptacle 218 defines a recess 220 (FIGS. 12 and 14) into which the bottom end 216 of agitator post 202 may be removably inserted. Receptacle 218 may be formed as an integral portion of impeller 204 or may be a separate component connected therewith.

Figure 11:
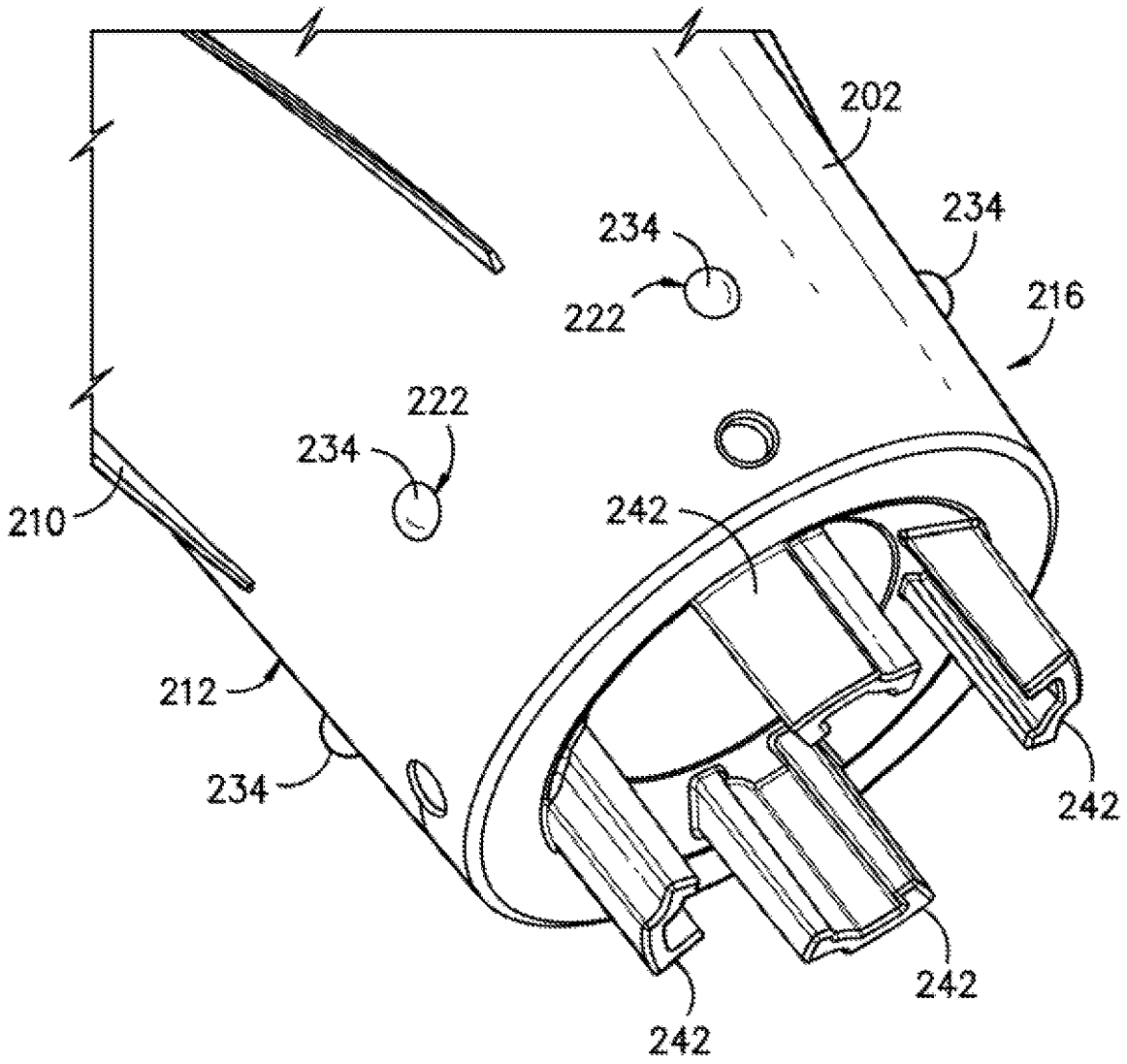
FIG. 11 is a perspective view of a bottom end of an exemplary agitator post.

When position in receptacle 218, agitator post 202 includes means for transferring torque 240 (FIGS. 7 and 8) between the impeller 204 and the agitator post. As shown in FIG. 11, a plurality of teeth 242 project from bottom end 216 of agitator post 202. Impeller 204 defines a plurality of complementary slots 244 (FIGS. 12 and 14) below recess 220 that are configured for removable receipt of the plurality of teeth 242. Accordingly, movement of impeller 204 is transferred to agitator post 202, and teeth 242 and slots 244 ensure agitator post 202 does not slip or otherwise fail to move with impeller 204.

Receptacle 218 includes a cylindrically-shaped wall 268 that projects upwardly along vertical axis VA from impeller 204. A locking feature 250 is provided that, for this embodiment, is constructed as a lip or projection 252 extending around receptacle 218 and radially-inward from cylindrically-shaped wall 268. Locking feature 250 will be further described herein.

Agitator post 202 includes an interior 226 (FIG. 5) in which a shaft 224 is positioned and also extends between top end 214 and bottom end 216. Shaft 224 extends parallel to vertical axis VA. A plunger 230 is connected to a bottom end 232 of shaft 224 (FIG. 4) and is positioned within interior 226 proximate to bottom end 216. Plunger 230 is movable by shaft 224, and together the two are movable up and down along vertical axis VA between an up position shown in FIG. 6 and a down position shown in FIG. 7. In the up position shown in FIG. 6, agitator post 202 is locked into, or secured within, receptacle 218 and may not be removed therefrom. In the down position shown in FIG. 7, agitator post 202 may be readily removed or released from receptacle 218.

Plunger 230 has an outer face 238 (FIGS. 4 and 9) that defines a plurality of sockets 236, which are spaced apart along circumferential direction C on outer face 238. Each socket 236 includes an upper angled surface 264 and a lower angled surface 266 that facilitates movement of a plurality bearings 234. As used herein, "angled" means such surface is neither parallel to vertical axis VA or orthogonal thereto. In one exemplary embodiment, surfaces 264 and 266 are at an angle in the range of 20 degrees to 70 degrees measured from radial direction R (with is orthogonal to vertical axis VA). In another embodiment, such angle is 45 degrees or 60 degrees from radial direction R. Other values may be used as well.

Figure 6:
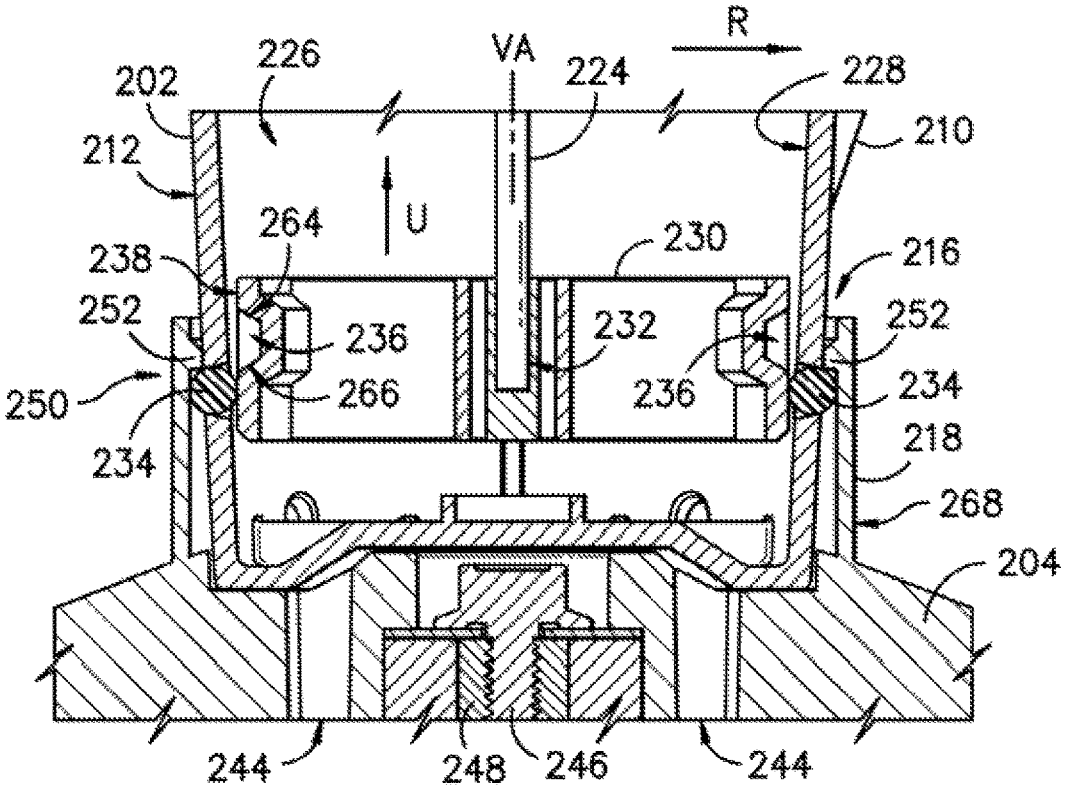
FIGS. 6 and 7 are cross-sectional side views of a portion of the exemplary article movement mechanism of FIG. 3.
Figure 7:
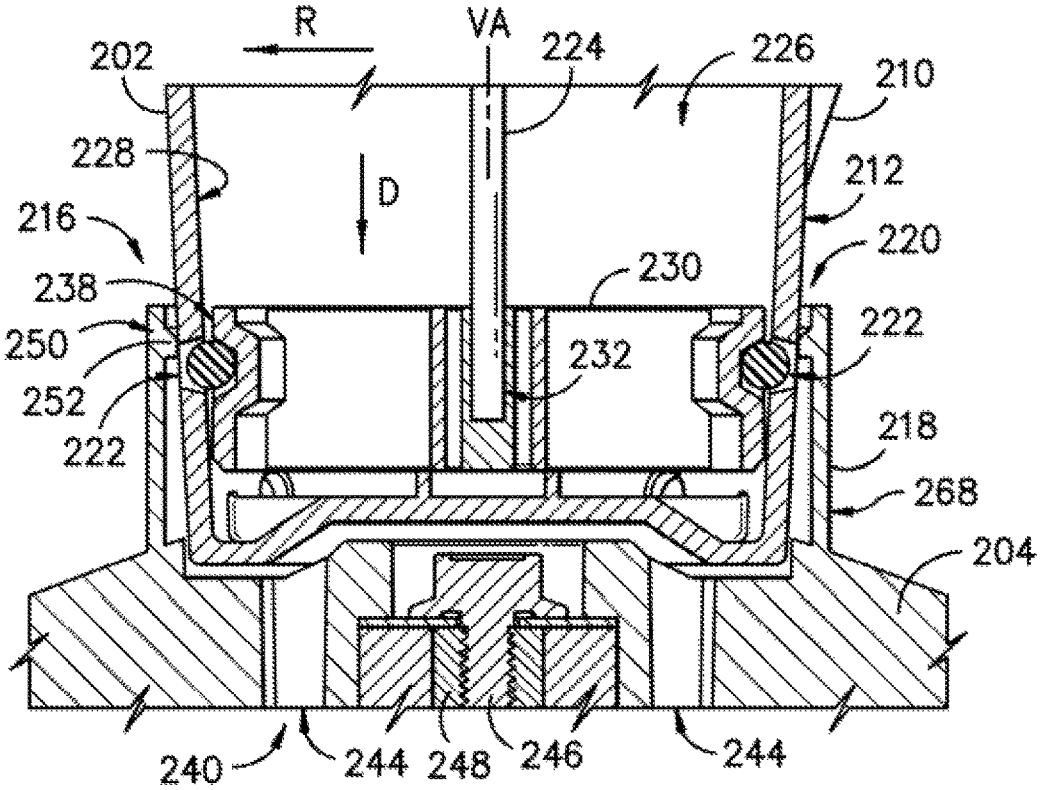
Figure 8:
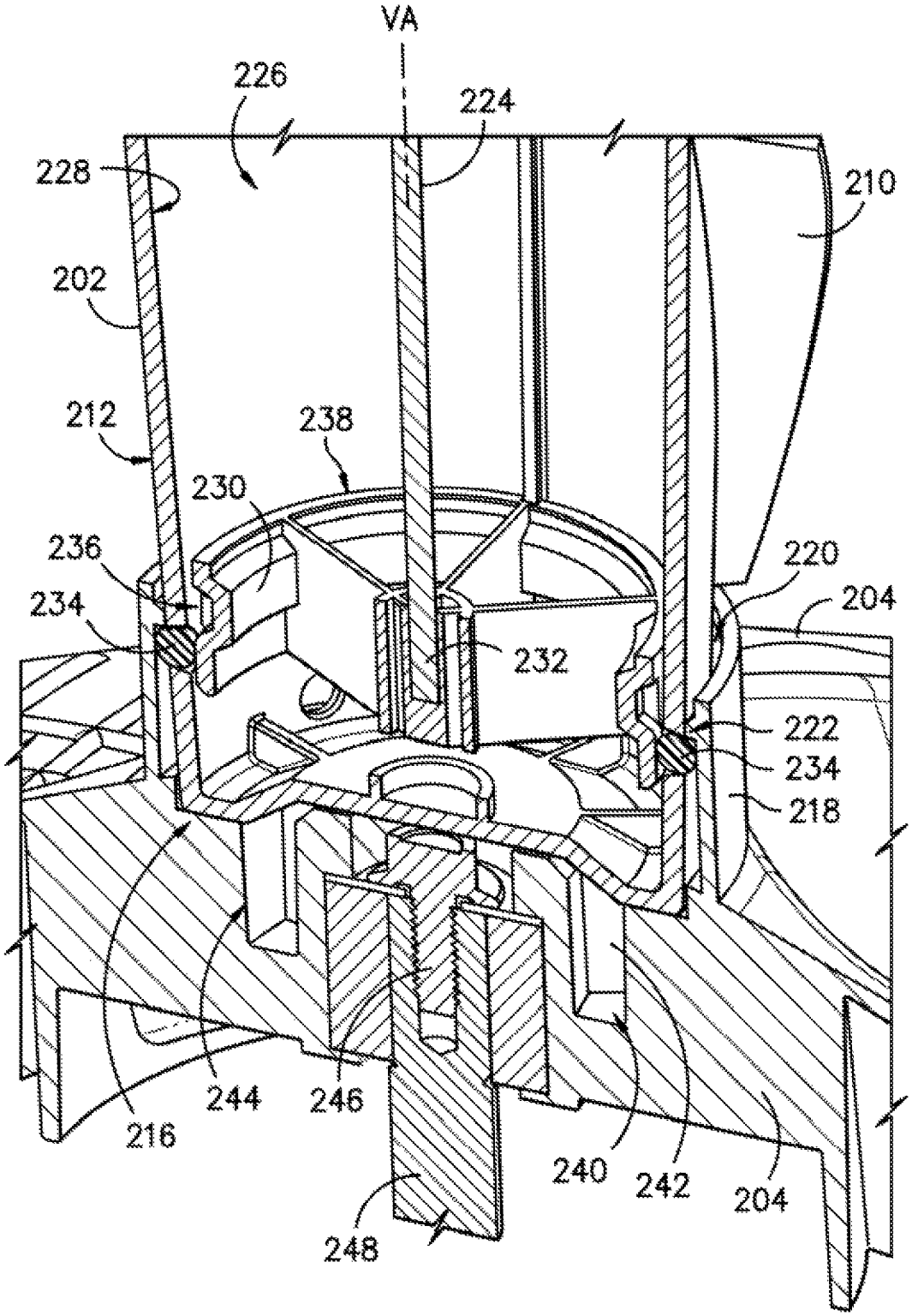
FIG. 8 is a perspective and cross-sectional side view of a portion of the exemplary article movement mechanism of FIG. 3.
Figure 9:
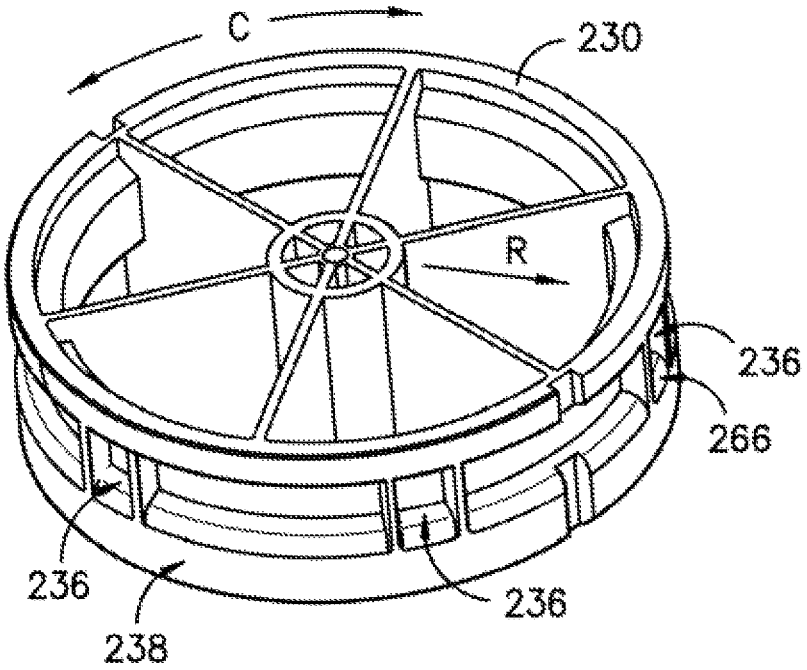
FIG. 9 is a perspective view of an exemplary plunger.
Figure 10:
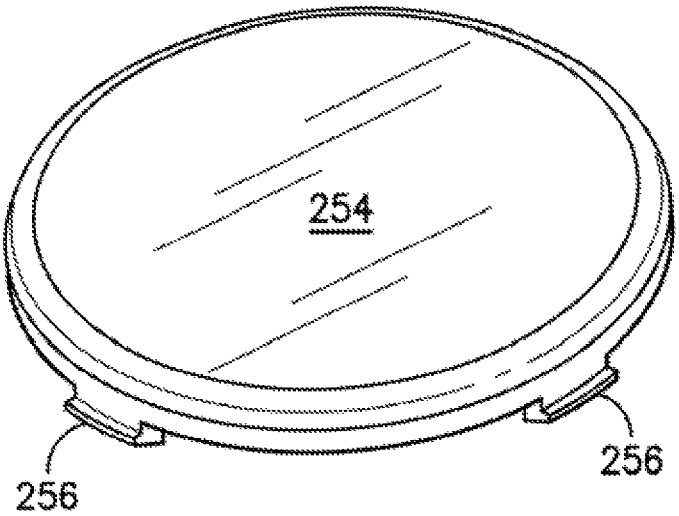
FIG. 10 a perspective view of an exemplary cap.

The plurality of bearings 234 are positioned circumferentially around agitator post 202 and are confined between plunger 230 and agitator post 202 (FIGS. 6 and 7). Each bearing 234 is positioned radially adjacent to one of the sockets 236 and one of the plurality of openings 222 positioned about bottom end 216 of agitator post 202. Bearings 234 are configured for selective contact with receptacle 218 so that a user may secure or release agitator post 202. More particularly, bearings 234 are movable back and forth between along radial direction R through openings 222 between sockets 236 and a cylindrically-shaped wall 268 of receptacle 218. Such movement back and forth is controller by the position of plunger 230, which determines whether bearings 234 are in or out of contact with receptacle 218 so as to secure or release, respectively, agitator post 202 from receptacle 218.

FIG. 6 depicts plunger 230 in an up position where bearings 234 are moved radially outward and in contact with wall 268 of receptacle 218. In the up position, the bottom of radially-outer face 238 of circular-shaped plunger 230 locks each bearing 234 into one of the openings 222 of agitator post 202 and in contact with wall 268. The removal of agitator post 202 from receptacle 218 is prevented because bearings 234 will interfere or contact one or more locking features 250 positioned in the receptacle 218—thereby prevent upward movement of agitator post 202 when plunger 230 is in the up position.

For this exemplary embodiment, the locking feature 250 is configured as lip or projection 252 extending continuously around receptacle 218 as previously described. In other embodiments of the invention, other locking features may be used. For example, a plurality of tabs or intermittent projections vertically aligned with bearings 234 may be used.

FIG. 6 depicts plunger 230 in down position where bearings 234 are free to move radially inward through openings 222 and into sockets 236. In the down position, radially outer face 238 no longer restricts movement of bearings 234. Instead, with sockets 236 now radially adjacent to openings 222, bearings 234 can move at least partially into sockets 236 such that bearings 234 will not longer prevent upward movement of agitator post 202 due to contact or interference with projection 252. As such, in this down position, agitator post 202 may be removed by moving agitator post 202 up along vertical direction V or reinstalled by moving down along vertical direction.

Figure 4:
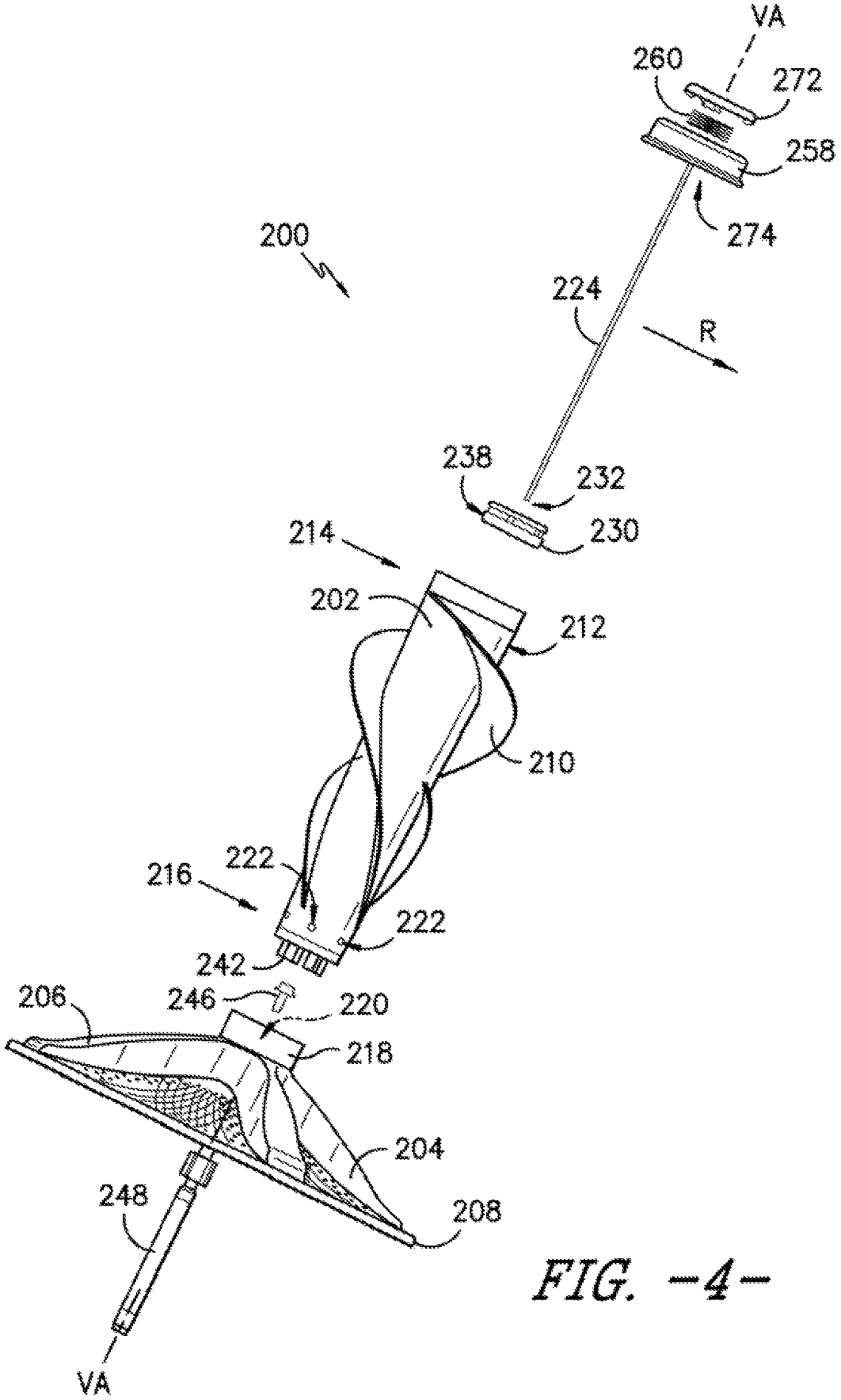
FIG. 4 provides an exploded view of the exemplary article movement mechanism of FIG. 3.
Figure 5:
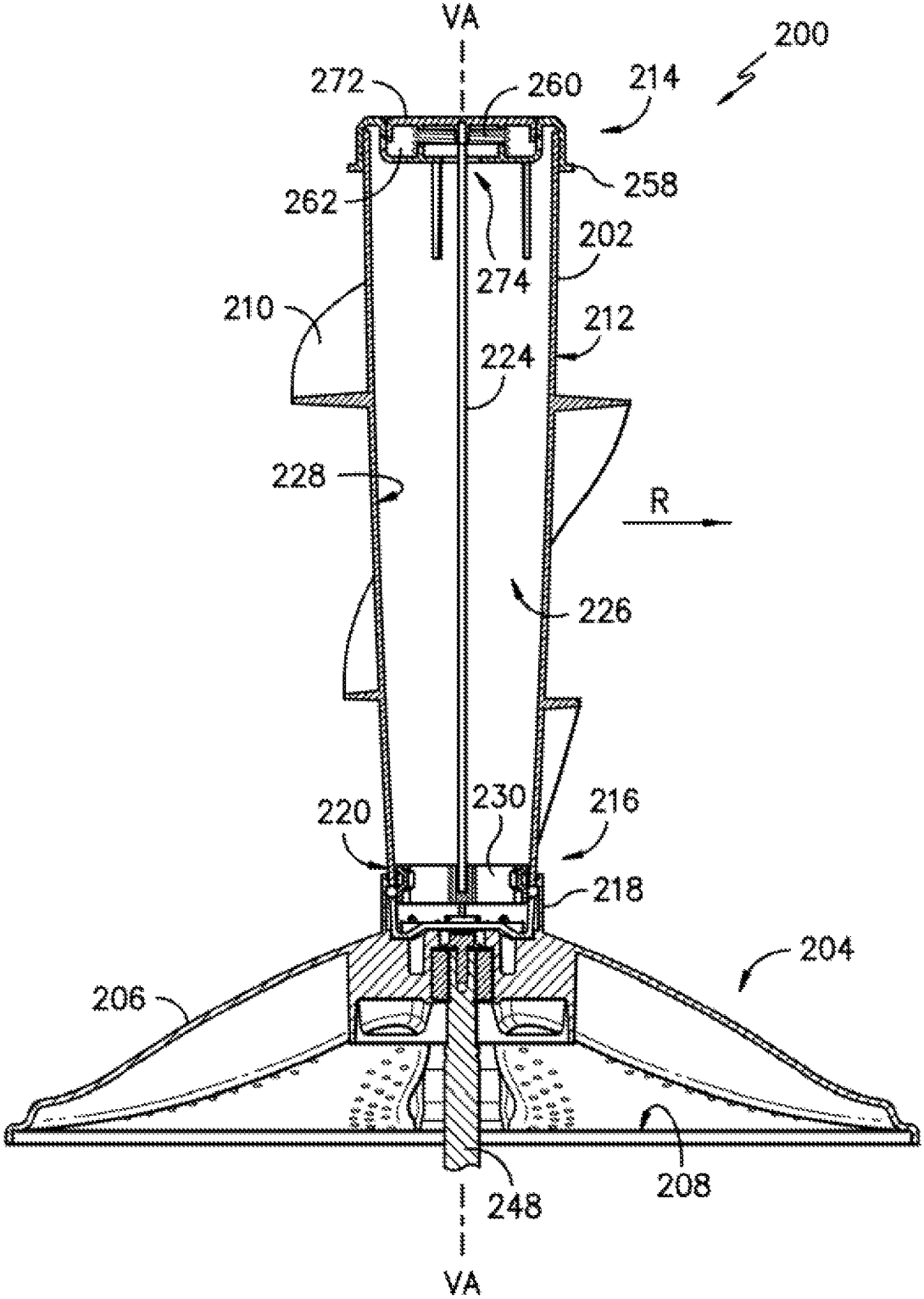
FIG. 5 is a cross-sectional side view of the exemplary article movement mechanism of FIG. 3.

For this exemplary embodiment, plunger 230 is biased towards the up position of FIG. 6 by a spring 260 located in a chamber 262 of collar 258 attached to top end 214 of agitator post 202 (FIGS. 4 and 5). Spring 260 is compressed between collar 258 and a movable button or actuator 272 at top end 214. Actuator 272 is connected with a top end 274 of shaft 224. Because bottom end 232 of shaft 224 is connected with plunger 230, the force provided by spring 260 urges plunger 230 into the up position shown in FIG. 6.

When actuator 272 is depressed by a user, shaft 224 is moved downwardly along vertical axis VA, which in turn moves plunger 230 downwardly along vertical axis VA as depicted by arrow D in FIG. 7. Once plunger 230 reaches the down position, agitator post 202 may be lifted out of receptacle 218 provided plunger 230 is maintained in the down position until bearings 234 clear projection 252. Upon removing agitator post 202 from receptacle 218, actuator 272 may be released.

To replace agitator post 202 into receptacle 218, the user again depresses actuator 272 and inserts bottom end 216 of actuator post 202 into receptacle 218. Once positioned, releasing the actuator 272 causes plunger 230 to move up as depicted by arrow U in FIG. 6 and return to the up position where bearings 234 move radially outward to lock agitator post 202 into place.

Openings 222 in bottom end 216 of agitator post 202 are configured to retain bearings 234. More particularly, as shown in in FIG. 15, each of the openings 222 has an opening diameter OD that tapers along a direction moving radially-outward from vertical axis VA. The opening diameter OD decreases along this direction to a size or diameter that is less than the bearing diameter BD of bearing 234, which prevents bearing 234 from moving radially outward to a position completely out of opening 222.

Figure 12:
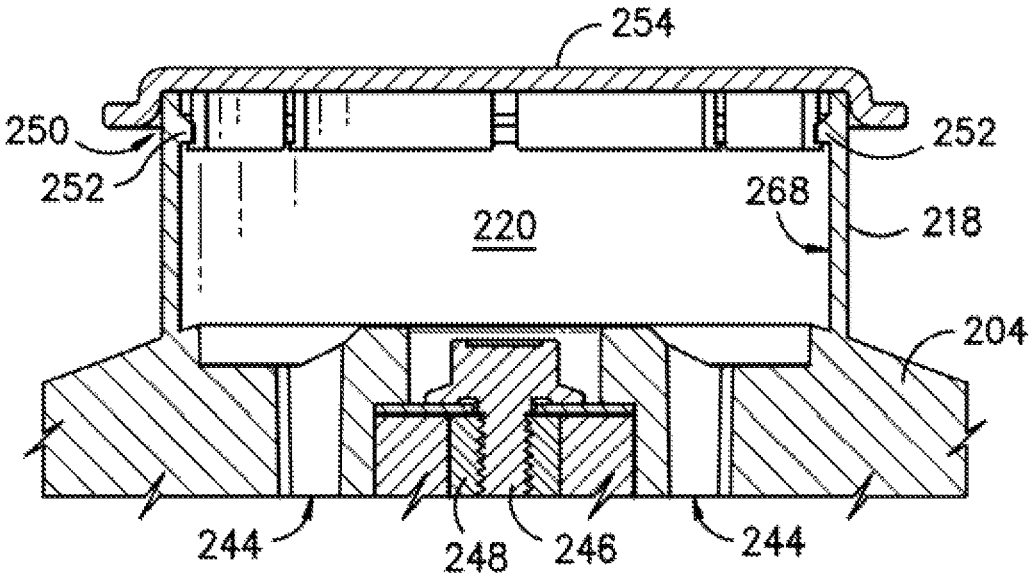
FIG. 12 is a cross-sectional side view of a portion of the exemplary article movement mechanism of FIG. 3 with the cap of FIG. 10 installed.
Figure 15:
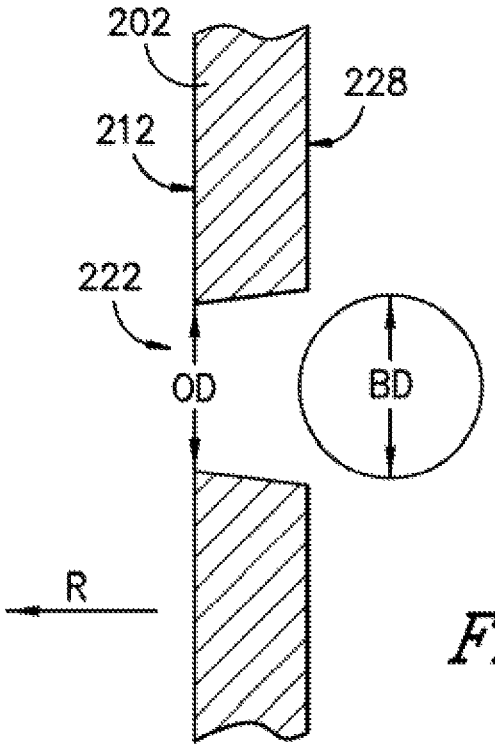
FIG. 15 is a cross-sectional side view of an exemplary opening and bearing of the article movement mechanism of FIG. 3.
Figure 13:
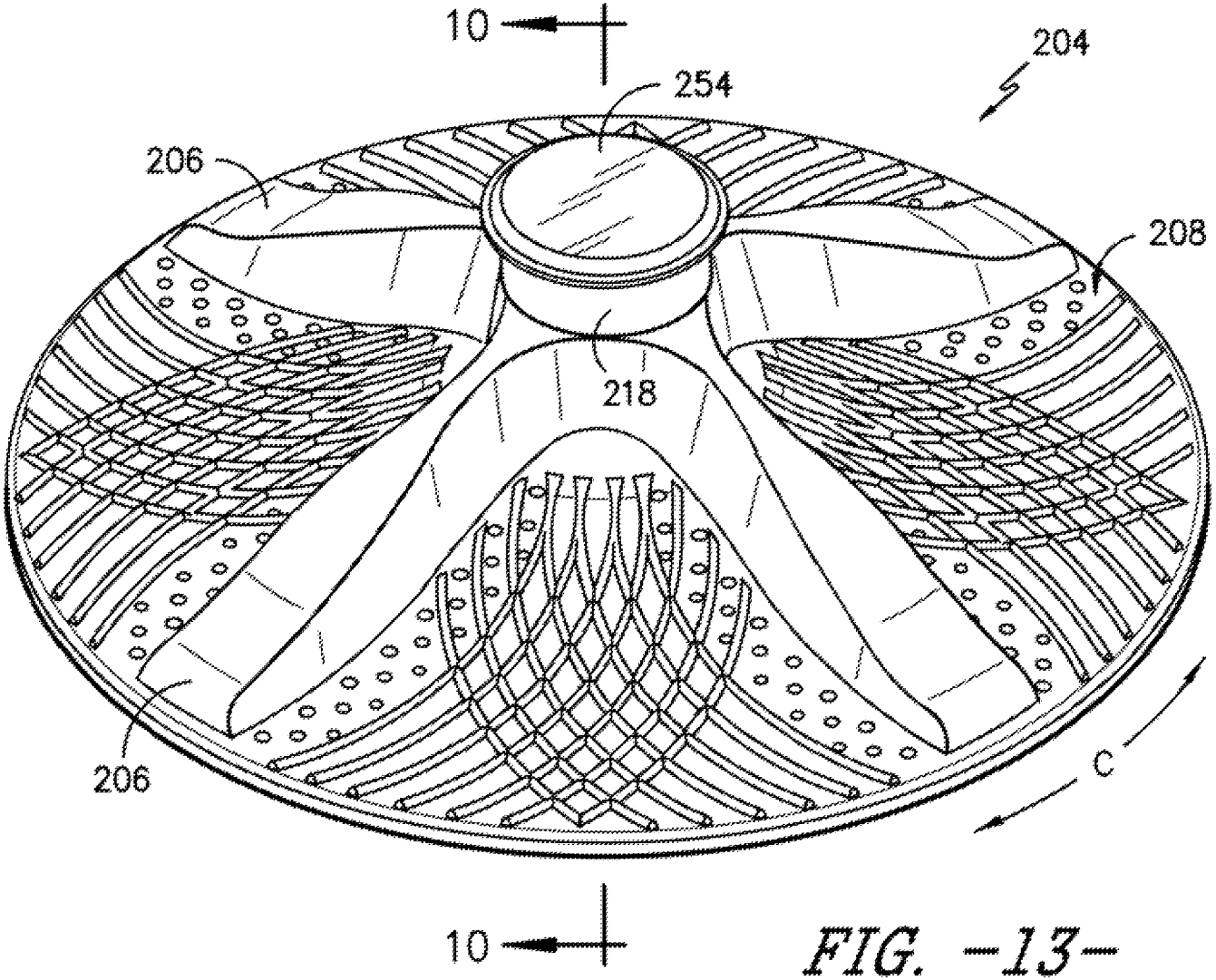
FIG. 13 is a perspective view of an exemplary impeller with the cap of FIG. 10 installed.
Figure 14:
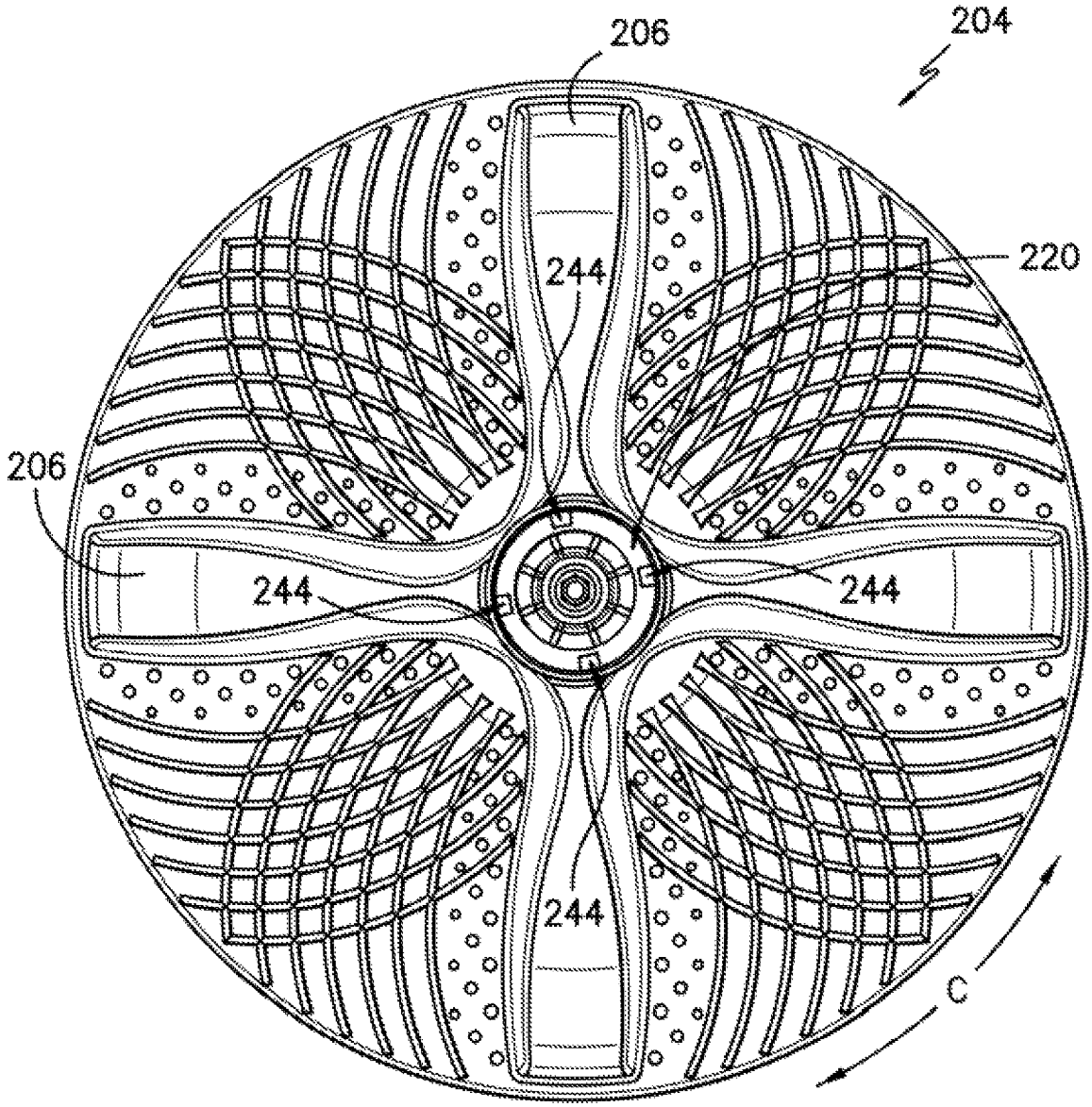
FIG. 14 is a top view of an exemplary impeller.

When agitator post 202 is removed from receptacle 218, a cap 254 (FIG. 10) may be used to enclose recess 220 as depicted in FIGS. 12, 13 and 14. Cap 254 includes tabs 256 that interfere with projection 252 to secure its position in receptacle 218.

A different number of bearings and receptacles may be used from that shown in the figures. Although shown as uniformly spaced along circumferential direction C, different spacings may be used as well. Additionally, the present invention is not limited to the particular shape, size, or configuration of agitator post 202 or impeller 204—including lobes 206 and vane 208.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing appliance, comprising:

a cabinet;

a wash tub positioned in the cabinet and defining a wash chamber;

a wash drum rotatably mounted within the wash chamber and configured for receiving articles for washing;

an impeller positioned in the wash drum, the impeller being rotational about a vertical axis and configured for imparting motion to the articles during washing, the impeller supporting a receptacle;

an agitator post configured for removable positioning in the receptacle of the impeller, the agitator post having a top end and a bottom end, the agitator post defining a plurality of openings positioned about the bottom end, wherein each opening of the plurality of openings has an opening diameter that tapers along a radial direction;

a shaft positioned within the agitator post and extending between the top end and the bottom end of the agitator post;

a plunger attached to the shaft near the bottom end of the agitator post, the plunger movable between an up position and a down position along the vertical axis; and a plurality of bearings positioned between the plunger and the agitator post and configured for selective contact with the receptacle by movement through the openings at the bottom end of the agitator post so as to secure the agitator post in the receptacle when the plunger is in the up position and release the agitator post from the receptacle when the plunger is in the down position.

2. The washing appliance of claim 1, further comprising an actuator positioned within an opening at the top end of the agitator post, the actuator connected with the shaft whereby a user may use the actuator to move the shaft to position the plunger between the up position and down position.

3. The washing appliance of claim 2, wherein the actuator is biased upwardly so as to return the plunger to the up position after being depressed by a user.

4. The washing appliance of claim 2, further comprising a plurality of teeth projecting from the bottom end of the agitator post, wherein the impeller defines a plurality of slots for removable receipt of the plurality of teeth.

5. The washing appliance of claim 1, further comprising a cap for removable positioning in the receptacle when the agitator post is not present.

6. The washing appliance of claim 1, wherein the plunger defines an outer face extending circumferentially around the plunger, the outer face comprising a plurality of sockets configured for receipt of the plurality of bearings when the plunger is in the down position.

7. The washing appliance of claim 1, further comprising one or more locking features positioned in the receptacle, the one or more locking features configured for contact with the plurality of bearings so as to prevent upward movement of the agitator post when the plunger is in the up position.

8. The washing appliance of claim 1, wherein the agitator post further comprises a helical vane extending around an outer surface of the agitator post and the impeller comprises a plurality of lobes spaced-apart along a circumferential direction of the impeller.

9. The washing appliance of claim 1, wherein each bearing of the plurality of bearings has a bearing diameter, and wherein each opening diameter tapers along the radial direction to a size that is smaller than the bearing diameter.

10. A washing appliance, comprising:

a wash drum rotatably mounted within a wash chamber and configured for receiving articles for washing;

an impeller positioned in the wash drum, the impeller being rotational about a vertical axis and configured for imparting motion to the articles during washing;

a receptacle supported by the impeller;

an agitator post removably positioned in the receptacle, the agitator post and having a top end and a bottom end, the agitator post defining a plurality of openings at the bottom end, the openings oriented and tapered along a radial direction;

a shaft extending withing the agitator post, the shaft movable up and down along a direction parallel to the vertical axis;

a plunger connected with the shaft and positioned proximate to the bottom end of the agitator post, the plunger configured for movement by the shaft between an up position and a down position, the plunger defining a plurality of sockets spaced apart along a circumferential direction; and a plurality of bearings confined between the plunger and the agitator post, each bearing movable between one of the sockets and one of the openings of the agitator post when the plunger is in the down position, each bearing forced into one of the openings in locking contact with the receptacle when the plunger is in the up position.

11. The washing appliance of claim 10, further comprising an actuator positioned at the top end of the agitator post, the actuator configured for causing the shaft to move the plunger when the actuator is pressed.

12. The washing appliance of claim 11, further comprising a spring that urges the plunger towards the up position.

13. The washing appliance of claim 12, wherein the spring is compressed between the actuator and the agitator post.

14. The washing appliance of claim 13, further comprising means for transferring torque between the impeller and the agitator post.

15. The washing appliance of claim 14, further comprising a projection extending radially inward within the receptacle and around the receptacle, the projection configured for locking contact with the plurality of bearings so as to prevent upward movement of the agitator post when the plunger is in the up position.

16. The washing appliance of claim 15, wherein each opening of the plurality of openings has an opening diameter and each bearing of the plurality of bearings has a bearing diameter, and wherein each opening diameter tapers along a radial direction to a size that is smaller than the bearing diameter.

17. The washing appliance of claim 16, further comprising a cap for removable positioning in the receptacle when the agitator post is not present.

18. The washing appliance of claim 17, wherein the agitator post further comprises a helical vane extending around an outer surface of the agitator post and the impeller comprises a plurality of lobes spaced-apart along a circumferential direction of the impeller.

* * * * *